US006105975A

United States Patent [19]

Shum

[11] Patent Number: 6,105,975

[45] Date of Patent: Aug. 22, 2000

[54] SKATE BLADE HOLDING SYSTEM

[75] Inventor: Albert Shum, Portland, Oreg.

[73] Assignee: Nike, Inc., Beaverton, Oreg.

[21] Appl. No.: 09/015,914

[22] Filed: Jan. 30, 1998

[51] Int. Cl.[7] ..... A63C 3/12

[52] U.S. Cl. ..... 280/7.13; 280/11.14; 280/11.12

[58] Field of Search ..... 280/5.3, 11.14, 280/7.13, 11.22, 11.28, 11.19, 11.27, 811, 11.12

[56] References Cited

U.S. PATENT DOCUMENTS

| | | | |
|---|---|---|---|
| 214,563 | 4/1879 | Harwood . | |
| 388,693 | 8/1888 | La Chaine | 280/11.14 |
| 403,052 | 5/1889 | King | 280/11.14 |
| 618,780 | 1/1899 | Bustin | 280/11.14 |
| 911,346 | 2/1909 | Tait et al. | 280/11.14 |
| 1,245,737 | 11/1917 | King | 280/11.14 |
| 1,263,092 | 4/1918 | Miers | 280/11.14 |
| 1,263,093 | 4/1918 | Miers | 280/11.14 |
| 1,597,792 | 8/1926 | Hoff et al. | 280/11.14 |
| 1,702,316 | 2/1929 | Ridgers | 280/11.14 |
| 2,019,738 | 11/1935 | Smith | 280/11.14 |
| 2,826,422 | 3/1958 | Snyder . | |
| 3,026,119 | 3/1962 | Bauer | 280/11.18 |
| 3,095,208 | 6/1963 | Shaw . | |
| 3,199,883 | 8/1965 | Freeman | 280/11.14 |
| 3,322,437 | 5/1967 | Bauer . | |
| 3,545,778 | 12/1970 | Weidenbacker . | |
| 3,967,832 | 7/1976 | Chambers . | |
| 4,071,938 | 2/1978 | Chambers . | |
| 4,074,909 | 2/1978 | Baikie . | |
| 4,085,944 | 4/1978 | Chambers . | |
| 4,196,915 | 4/1980 | Cerny | 280/11.18 |
| 4,294,455 | 10/1981 | Krueger . | |
| 4,521,029 | 6/1985 | Mayes | 280/7.14 |
| 4,909,523 | 3/1990 | Olson . | |
| 4,932,675 | 6/1990 | Olson et al. . | |
| 5,135,244 | 8/1992 | Allison . | |
| 5,330,208 | 7/1994 | Charron et al. . | |
| 5,342,071 | 8/1994 | Soo | 280/11.22 |
| 5,362,075 | 11/1994 | Szendel . | |
| 5,366,232 | 11/1994 | Pozzobon et al. . | |
| 5,388,845 | 2/1995 | Soo . | |
| 5,411,278 | 5/1995 | Wittman | 280/11.22 |
| 5,441,286 | 8/1995 | Pozzobon | 280/11.27 |
| 5,484,148 | 1/1996 | Olivieri . | |
| 5,503,413 | 4/1996 | Belogour . | |
| 5,533,740 | 7/1996 | Lin . | |
| 5,536,025 | 7/1996 | Landay | 280/11.22 |
| 5,630,598 | 5/1997 | Zorzi et al. | 280/11.28 |
| 5,685,551 | 11/1997 | Zorzi et al. | 280/11.22 |
| 5,690,344 | 11/1997 | Chen | 280/11.28 |
| 5,931,480 | 8/1999 | Schroeder | 280/11.28 |
| 5,934,692 | 8/1999 | Artus | 280/11.22 |
| 6,012,727 | 1/2000 | Chang | 280/11.28 |

FOREIGN PATENT DOCUMENTS

| | | |
|---|---|---|
| 585720 | 10/1959 | Canada . |
| 1102842 | 6/1981 | Canada . |
| 1105510 | 7/1981 | Canada . |
| 1088968 | 11/1998 | Canada . |

*Primary Examiner*—Brian L. Johnson
*Assistant Examiner*—Bridget Avery
*Attorney, Agent, or Firm*—Banner & Witcoff, Ltd.

[57] ABSTRACT

A lightweight ice skate for reducing and eliminating the vibrations experienced by a skater. The skate includes a skate blade, a plurality of bumpers and a pair of metal support mounts to which a skate boot is secured. The support mounts include blade receiving portions in which the skate blade is secured. Vibration dampening members formed of an elastomeric material are placed within the support mounts for spacing the support mounts from fasteners that secure the skate blade to the support mounts in order to isolate the skater from the vibrations experienced by the skate blade. In another preferred embodiment of the invention, the bumper includes a single, unitary bumper extending between the front and rear of the skate blade.

21 Claims, 5 Drawing Sheets

SKATE BLADE HOLDING SYSTEM

FIELD OF THE INVENTION

The invention relates to an ice skate, and in particular to a vibration dampening skate blade assembly which dampens vibrations experienced by a skate blade before they reach the skater.

BACKGROUND OF THE INVENTION

Ice skates typically include a skate boot, a skate blade and a blade holder system for coupling the blade to the boot. Blade holder systems typically include forward and rearward support mounts having mounting plates for receiving a skate boot, a blade holding member for receiving and securing a blade and columns for supporting the mounting plates above the skate blade and its holder. Some older skates also include rounded members or bumpers typically positioned at the front and rear of the blade to cover the ends for the protection of other skaters.

Ice skate blade holder systems were originally designed to include wooden supports. However, it quickly became apparent that these supports were not adequate for many activities including hockey, speed skating and figure skating. As a result, blade holder systems including metal support columns and a metal blade holding member for attaching to a thick metal skate blade were developed. These metal holder systems increased the safety of the skate, but significantly increased its overall weight and reduced skating speed. These drawbacks led to the development of the tubular blade holder which was lighter than its solid metal predecessor and provided sufficient strength and rigidity during a skating stride. Tubular blade holders also allowed for the use of a lighter, thinner skate blades. The overall weight reduction of the skate resulted in faster speeds without sacrificing the safety of the skate or durability of the blade and its function.

In the quest for lighter and faster skates, all-plastic blade holder systems, such as those currently used, were developed. Plastic systems were lighter than their conventional metal counterparts and less expensive to manufacture. However, plastic blade holder systems have a higher failure rate than their metal counterparts. For example, they fail more often than a metal blade holder when hit by a puck moving at a high velocity. Also, plastic blade holders do not provide the control, responsiveness and power offered by metal blade holder systems.

Contemporary rigid blade holder systems, whether plastic or metal, include rigid coupling members for securing the blade thereto. The vibrations and shocks felt by the blade due to poor ice surfaces and external blows are transmitted by the rigid coupling member to the rest of the rigid blade holder system and ultimately the skater. The transmitted vibrations can cause skaters to loose their balance resulting in a fall or a loss in skating speed. After prolonged skating, constant shock and vibrations received by the joints of the body can lead to pain during and after skating.

It is an object of this invention is to provide an ice skate having a blade holder system overcoming the problems associated with the prior art.

It is also an object of this invention to provide an ice skate with a blade holder system which absorbs the vibrations experienced by the skate blade, while maintaining a light overall weight and increasing power transfer from the skater to the blade.

SUMMARY OF THE INVENTION

The present invention relates to an ice skate including a skate boot and a skate blade holder system. The blade holder system includes first and second metal support mounts, each of which includes a blade receiving portion and a boot receiving surface for securing a portion of the skate boot thereto. The skate also includes a skate blade secured to the blade receiving portions by at least one fastener. The blade has an upper edge and a surface contacting edge. At least one vibration dampening member is positioned within one of the support mounts for dampening vibrations experienced by the skate blade. The vibration dampening member is positioned between the support mount and the fastener used to secure the skate blade to the support mount. The dampening member can also extend between the fastener and the skate blade.

The skate blade holder system according to the present invention dampens the vibrations experienced by the skate blade and increases the power transfer from the skater to the ice. By dampening the vibrations from puck impact or poor ice before they reach the skater, the skate blade holder system provides a more comfortable and enjoyable skating experience. Vibration dampening also results in a more powerful and efficient stride as a result of better balance and greater control when skating over uneven surfaces. The supports of the present invention are formed of a lightweight material such as metal, metal matrix composites or carbon/KEVLAR composites. The supports include a plurality of cutouts which reduce the weight of the skate without effecting the overall integrity of the blade holder. In comparison to the prior art skates, the very stiff; lightweight blade holder system increases power transfer from the skater to the ice surface, holds the edge of the skate blade longer and controls the direction of the blade better. The lighter weight blade holder system of the present invention also provides all the power and control advantages of a metal holder system with the weight of plastic.

DETAILED DESCRIPTION OF THE PREFERRED EMBODIMENTS

Figure 1A:
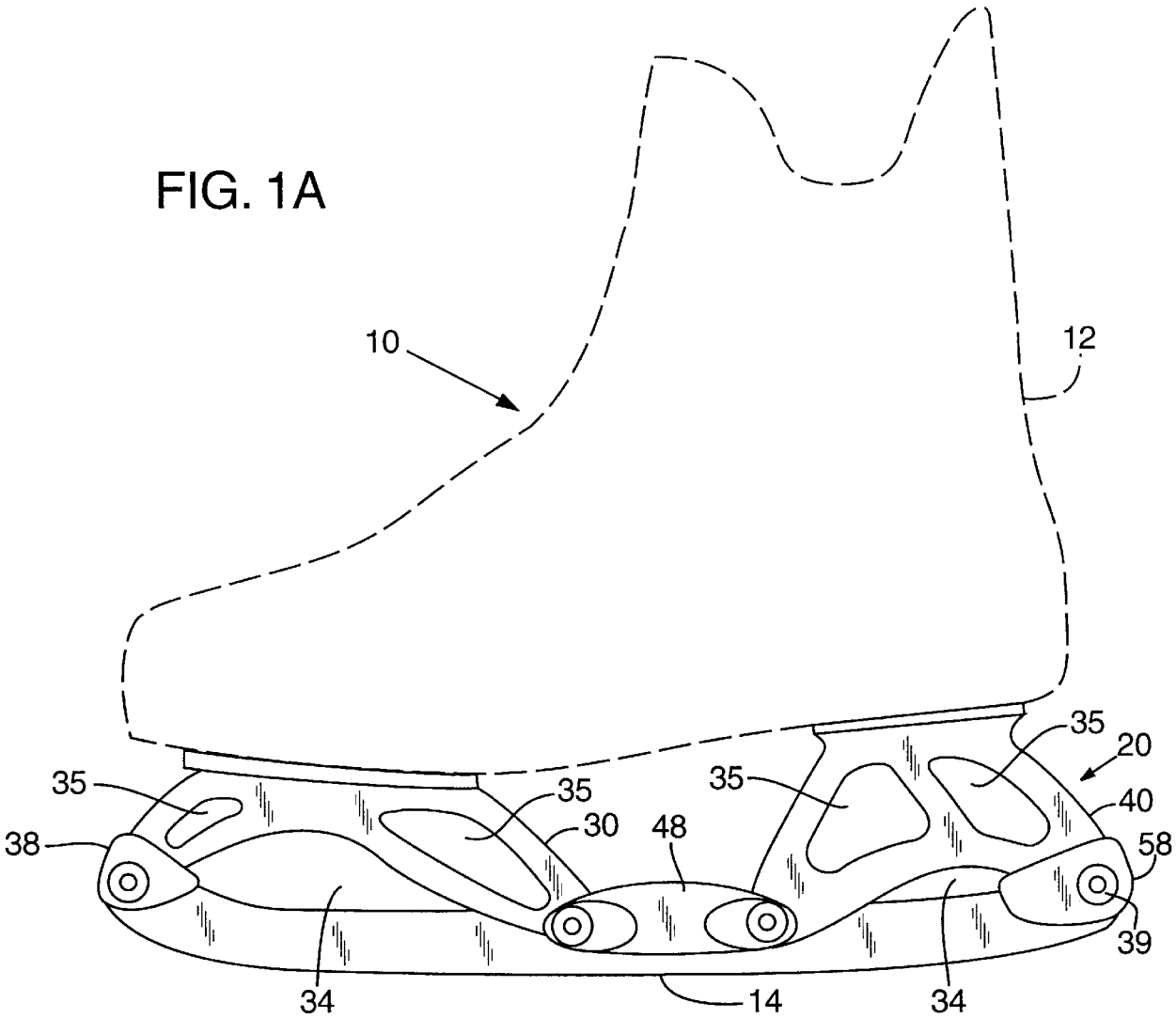
FIG. 1A is an elevational view of an ice skate according to a first embodiment of the present invention.

As shown in FIG. 1, an ice skate 10 according to the present invention includes a boot 12, a skate blade 14 and a skate blade holder system 20. Skate boot 12 receives the foot of the user and secures it relative to the skate blade while skating. Any type of conventional skate boot or other foot receiving members that secure the foot of a skater relative to the blade can be used with the skate blade holder system of the present invention. Skate blade 14 supports the skater above the ice and cuts into the ice surface during the skating stride as is well known. Skate blade 14 is formed of a high grade steel, preferably stainless steel. Stainless steel blades hold their edges longer, cut into the ice better and will not rust over time.

Figure 2:
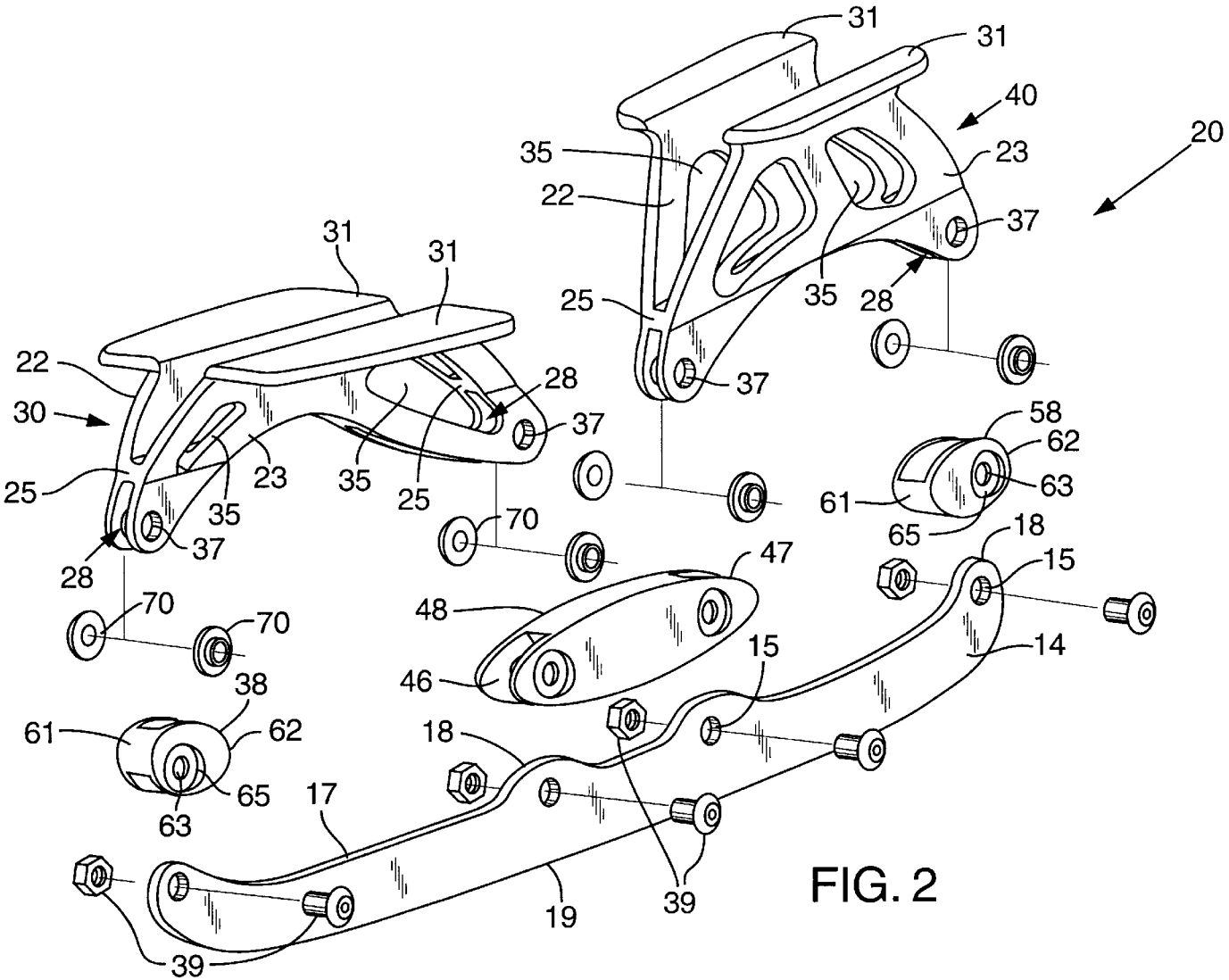
FIG. 2 is an exploded perspective view of the skate blade holder system in accordance with the first embodiment of the present invention as shown in FIGS. 1A and 1B.
Figure 6:
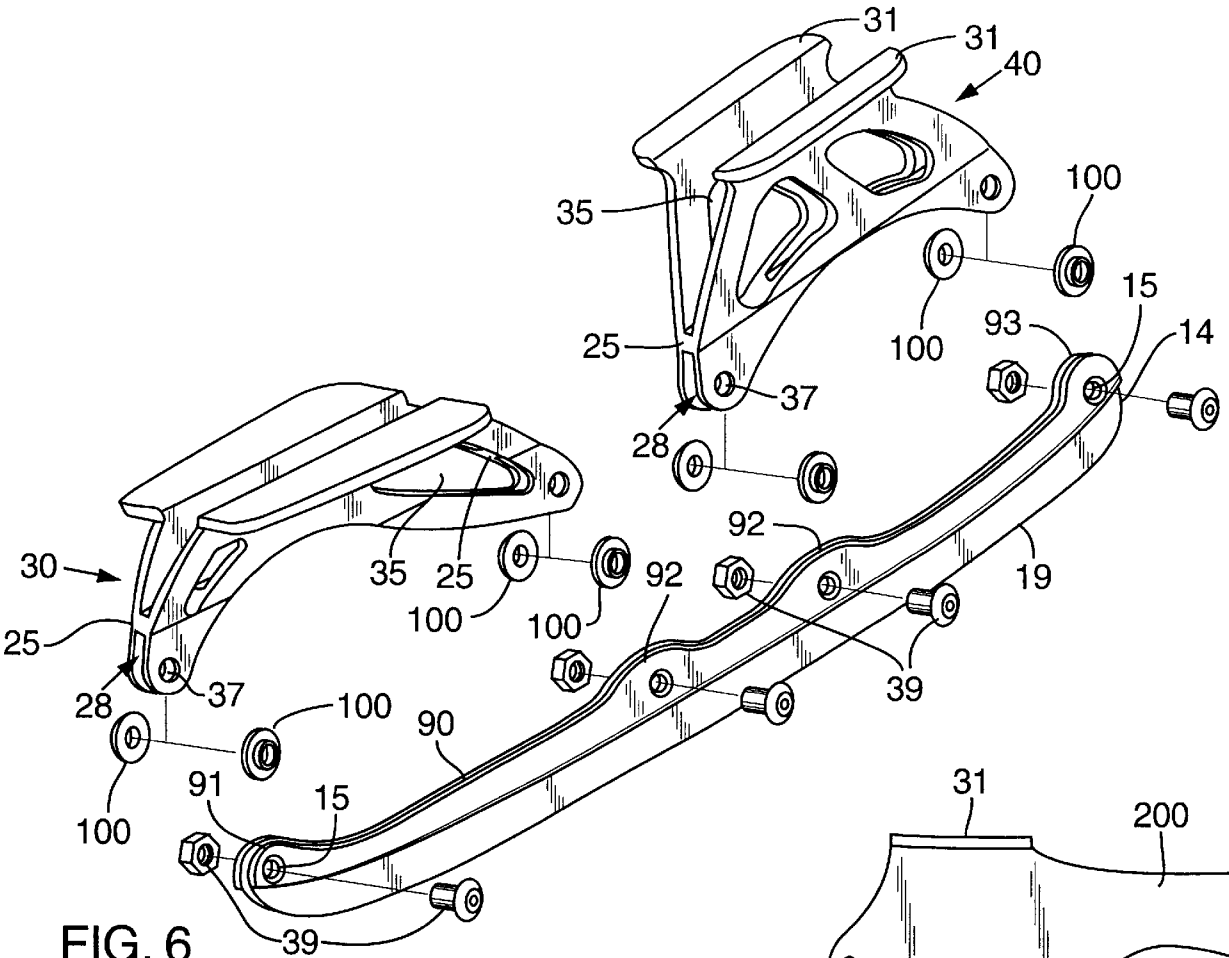
FIG. 6 is an exploded perspective view of the skate blade holder system embodiment shown FIG. 1C.

Skate blade 14 includes an upper surface 17 opposite its ice engaging surface 19. Upper surface 17 can be contoured with raised regions 18 corresponding to the location of through-holes 15 as shown in FIGS. 2 and 6. In an alternative embodiment, the upper surface can have a different shape such as being flat. Through-holes 15 are located along the length of blade 14 and partially within raised regions 18. A first through-hole 15 is located proximate the front of blade 14. A central pair of through-holes 15 is located about the middle section of blade 14, and a fourth through-hole 15 is proximate the rear of blade 14. The number of through-holes 15 may vary depending on the size or style of skate 10. Through-holes 15 receive a fastener 39, preferably a threaded fastener such as a bolt, for securing the blade to blade holder system 20. However, other well known types of fasteners, such as rivets, may also be used.

Figure 7:
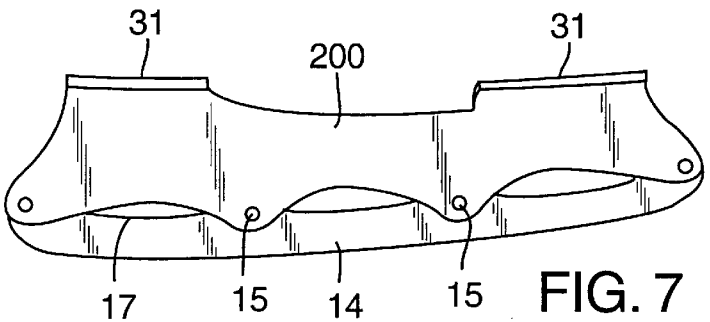
FIG. 7 is a perspective view of a blade holder system and skate blade according to a third embodiment of the present invention.

Skate blade holder system 20 includes a forward support mount 30 spaced from rearward support mount 40. Each support mount 30, 40 includes a pair of mounting plates 31 to which the forward and heel portions of skate boot 12 are secured using rivets, screws, straps or other well known securing and fastening members. The support mounts 30, 40 are formed of a lightweight, stiff, rigid metal such as aircraft grade aluminum. Other materials that can be used to form the support mounts include metal matrix composites and carbon fiber/KEVLAR composites. One such metal matrix composite which can be used for support mounts 30, 40 is aluminum with silicon carbide. The use of support mounts formed of a lightweight metal or one of the composites mentioned above provides the skater with a more powerful and controlled stride when compared to traditional plastic blade holder systems without sacrificing the overall weight of the skate. The use of metal supports mounts also gives a skater more control over the direction of the blade and enables a skater to hold an edge longer. The support mounts may also be part of a unitary, one-piece blade holder system 200, as shown in FIG. 7, formed of the lightweight metal or composites mentioned above. Blade 14 is secured to blade holder system 200 using fasteners 39. The spacers discussed below can be placed between blade holder system 200 and fasteners 39 to dampen vibrations experienced by blade 14.

Figure 3:
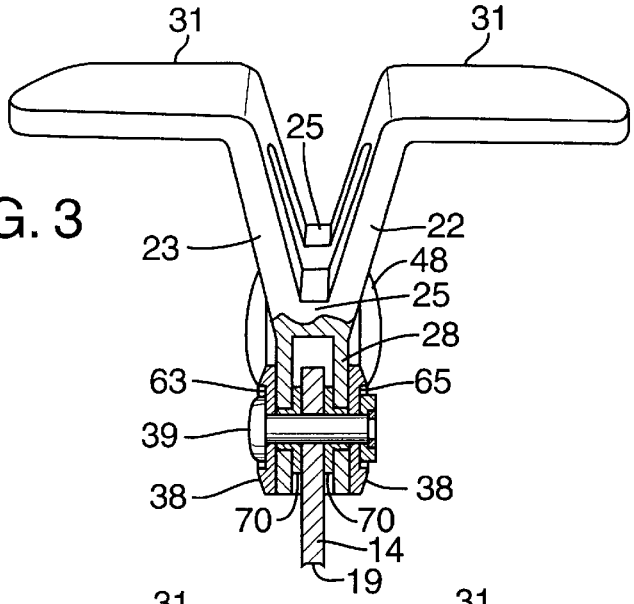
FIG. 3 is a cross sectional view taken along the line 3—3 of FIG. 1B.

As shown in FIGS. 2 and 3, each support mount 30, 40 has a triangulated, "Y" shaped cross section and supports the skate boot above blade 14. Each support mount 30, 40 includes a first side plate 22 and a second side plate 23, each having a mounting plate 31. Side plates 22, 23 extend away from cross support members 25 and each other at an angle of 30 degrees to form the "V" portion of the "Y" shaped cross section. Support members 25 extend between plates 22 and 23 and secure plates 22, 23 together. The angled orientation of side plates 22, 23 increases energy transfer from the skater to the skating surface, thereby making the skating stride more efficient. The larger the angle between side plates 22, 23, the more stable a platform that is created by coextensive mounting plates 31. The size of the angle is limited by the width of the outsole of the skate boot and the amount of space required for attaching the outsole to the boot. The angle between the side plates 22, 23 is greater for support mount 30 than for support mount 40 because the mounting area in the heel of boot 12 is smaller than the area in the forefoot of boot 12. The smaller mounting area in the heel requires the mounting plates 31 of support mount 40 to be positioned closer together than they are for support mount 30, thus a smaller angle is formed between plates 22, 23 of support mount 40. As seen in FIG. 1, the heel mounting plates 31 are also spaced at a greater height away from blade 14 than those of support mount 30 to optimally position the foot of the skater during a stride.

Blade 14 is secured within a channel 28 defined by the inside surfaces of plates 22 and 23 and a lower surface of cross support members 25 as discussed below. The width of channel 28 is determined by the length of cross support member 25 and the thickness of blade 14. The thicker skate blade 14, the wider channel 28 and the longer cross support member 25 are constructed.

The first and second side plates 22, 23 of support mount 30 extend forward to the front end of blade 14 and rearward toward the middle of blade 14. The side plates 22, 23 of support mounts 40 extend to the rear end of blade 14 and forward toward the middle of blade 14. Each side plate 22, 23 includes a plurality of openings 35 and fastener receiving holes 37. The lower contour of each side plate 22, 23 is curved such that an opening 34 is formed between the side plates 22, 23 and upper surface 17 of blade 14. The curve of support mount 30 and the resulting opening 34 are larger than the corresponding curve and opening of support mount 40 because of the size of support mount 30 and the support required in the heel region of skate 10. The openings 34, 35 reduce the overall weight of blade holder system 20 and skate 10 when compared to contemporary metal blade holder systems without sacrificing stability, control or power as experienced with plastic blade holders. The openings also aid in the power transfer from the skater to the skating surface by focusing the force of the skating stride on particular locations along blade 14.

Figure 1B:
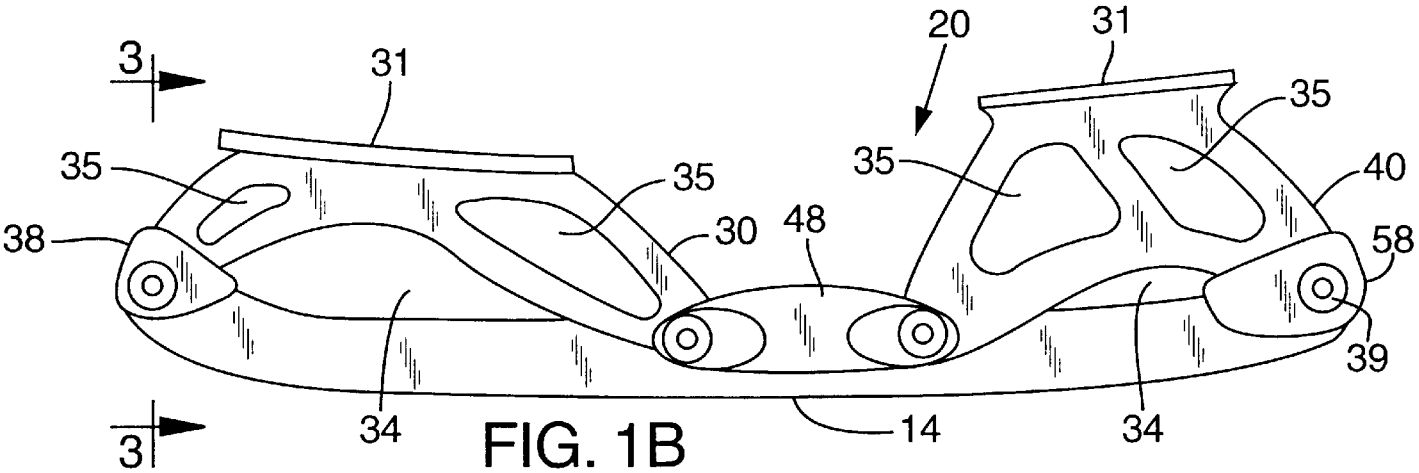
FIG. 1B is an elevational view of an ice skate according to the first embodiment of the present invention without the skate boot.

As shown in FIGS. 1B and 2, bumpers 38, 48, 58 are removably secured to skate blade 14 at different locations along its length so they can be removed if necessary. A recess 65 is formed in each of the outer sides 64 of bumpers 38, 48, 58 for receiving first and second ends of fastener 39. Bumpers 38, 48, 58 can be made of a hard, impact resistant material having a Shore A durometer of at least 90 such as thermoplastic polyurethane (TPU) or thermoplastic rubber (TPR). Bumpers 38, 48, 58 can also be formed of a resilient elastomeric material having a Shore A durometer of about 60 for dampening the vibrations experienced by the skate blade as a result of poor ice surfaces or puck impact. The elastomeric materials include TPU's such as TEXIN available from BAYER and ESTALOC available from UNIROYAL, or IPR's such as PBAX. The size and positioning of bumpers 38, 48, 58 also help to prevent the puck from contacting blade 14 when it impacts skate 10.

Bumpers 38 and 58 are positioned at the front and rear of blade 14, respectively, for preventing the edges at each end of blade 14 from contacting and injuring a skater. Bumpers 38 and 58 include an open internal area for receiving raised regions 18 of blade 14. Bumper 38 also receives the forward end of support mount 30 and bumper 58 receives the rear end of support mount 40. Bumpers 38, 58 include front and rear cross-members 61, 62 placed on opposite sides of raised region 18 for limiting the movement of the bumpers along blade 14. Cross-members 61, 62 also aid in the alignment of a through-hole 63 on each side of bumpers 38, 58 with its respective through bore 15 in blade 14.

Bumper 48 includes front and rear openings 46, 47 and is made from the same material as are bumpers 38, 58. Bumper 48 is located over the middle portion of blade 14 and receives the two middle raised regions 18. One raised region 18 and the rear end of support mount 30 are received within front opening 46. The other middle raised region 18 and the forward end of support mount 40 are received within rear opening 47. Bumper 48, along with blade 14, operatively couple the support mounts 30, 40 together for added stability and torsional stiffness.

Figure 4:
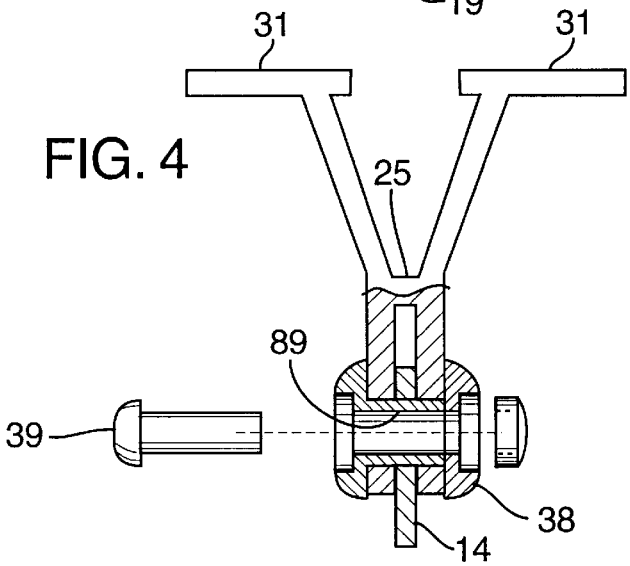
FIG. 4 is a cross sectional view of a support mount having a portion of a bumper extending therethrough.
Figure 5:
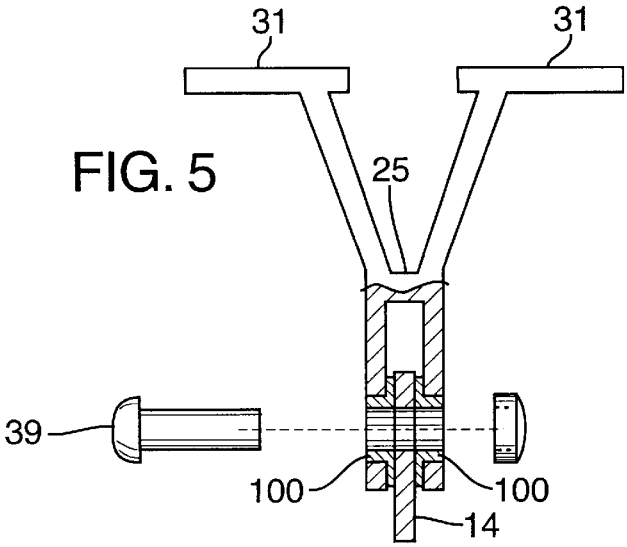
FIG. 5 is a cross sectional view taken along the line 5—5 of FIG. 1C without the bumper in place.

Vibration isolating and dampening spacers 70 formed of an elastomeric material, such as TPU are positioned on the internal side of plates 22, 23 and extend through receiving holes 37 in support mounts 30, 40 to isolate the support mounts from the vibrations transferred from blade 14 to fasteners 39. Fastener 39 is inserted through aligned holes 15, 63 and spacers 70 to secure the bumpers on blade 14 and for coupling blade 14, bumpers 38, 48, 58, and support mounts 30, 40 together. As shown in FIGS. 3 and 5, the spacers separate fastener 39 from the internal walls of fastener receiving holes 37. The outer ring of spacer 70 also separates the side of blade 14 from the side walls of the support mounts. As discussed above, the separation of the fastener from the support mount by a vibration absorbing, dampening material reduces, if not eliminates, the vibrations transferred to the skater from the skate blade to prevent a loss of balance when skating and provide a skater with a stronger and more stable stride. In an alternative embodiment, as shown in FIG. 4, the bumpers 38, 48 and 58 are formed of an elastomeric material and include a sleeve 89 inserted within holes 37 and through hole 15 for isolating the skater from the vibrations experienced by skate blade 14. In this embodiment, the elastomeric material is between the blade and the fastener as well as the fastener and the support.

Figure 1C:
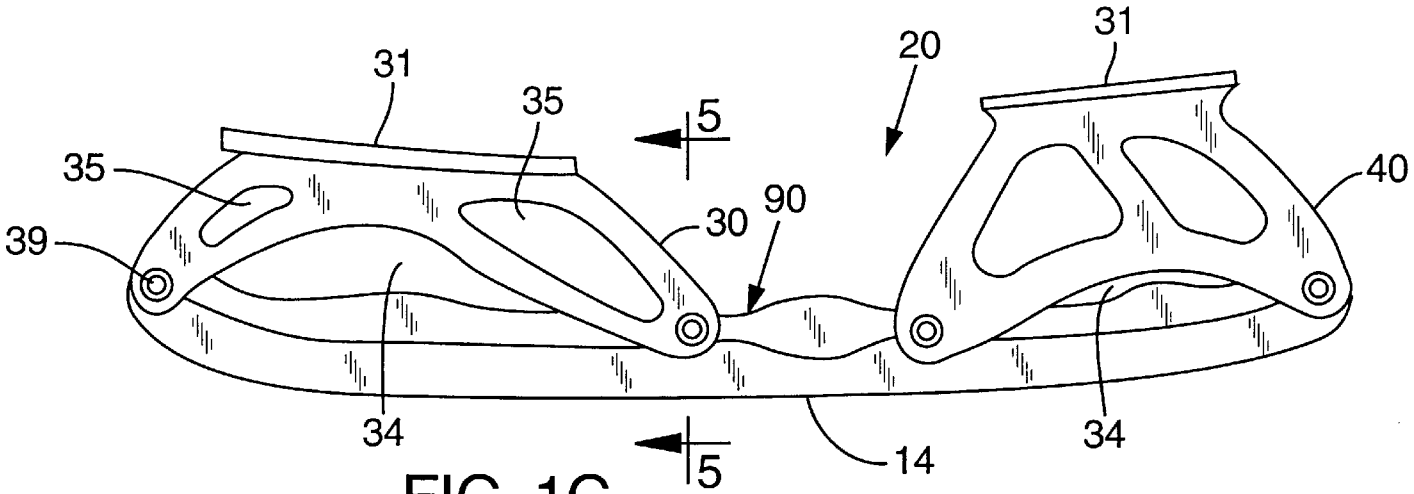
FIG. 1C is an elevational view of an ice skate according to a second embodiment of the present invention without the skate boot.

FIGS. 1C and 6 illustrate a unitary bumper 90 positioned over substantially the entire length of blade 14 to prevent the puck from impacting blade 14. Bumper 90 extends from in front of the forward most hole 37 in support 30 to behind the rear most hole 37 in support 40. For protection or to comply with safety requirements, if needed, the front end 95 and rear end 96 of bumper 90 can extend over the front and rear ends of blade 14, respectively, as do bumpers 38 and 58. Bumper 90 can include enlarged or bulged portions 91, 92, 93, as shown in FIG. 1C, that extend away from the blade a distance in the horizontal and vertical directions that is greater than the other portions of bumper 90 to prevent pucks from hitting blade 14. Enlarged areas 91, 92, 93 extend horizontally, outwardly away from the blade in the medial and lateral directions as well as vertically above and below the top surface of blade 14. In this embodiment, unlike that shown in FIGS. 1A and 1B, bumper 90 extends along blade 14 and is secured in between side plates 22, 23 of support mounts 30, 40 within channel 28. Bumper 90 includes a plurality of holes 97 for aligning with holes 15 in skate blade 14 and holes 37 in support mounts 30, 40. Fasteners 39 are inserted through the holes in bumper 90, supports 30, 40 and blade 14 to removably secure bumper 90 within channel 28 so that it can be easily changed if needed. Bumper 90 is formed of the same material as bumpers 38, 48, 58 and can be used with spacers 100 for separating the fastener 39 from support mounts 30, 40. As with bumpers 38, 48, 58, spacers 100 extend into holes 37 in support mounts 30, 40 for isolating the skater from the vibrations experienced by blade 14. In place of independent spacers 100, bumper 90 can be manufactured to include spacers. In this embodiment, the bumper 90 and its spacers are integrally formed as a single bumper system. As with spacers 70, the spacers with bumper 90 extend into holes 37 and separate fastener 39 from support mounts 30, 40 for isolating and dampening vibrations from blade 14. Bumper 90, as well as bumpers 38, 48 and 58, can be single piece units or formed of two pieces secured together.

Numerous characteristics, advantages and embodiments of the invention have been described in detail in the foregoing description with reference to the accompanying drawings. However, the disclosure is illustrative only and the invention is not limited to the illustrated embodiments. Various changes and modifications may be effected therein by one skilled in the art without departing from the scope or spirit of the invention.

What is claimed is:

1. An ice skate comprising:

(A) a skate boot for receiving the foot of a user;

(B) a blade holder including a first support mount having a blade receiving portion and at least one boot receiving surface for securing a portion of the skate boot thereto, and a second support mount having a second blade receiving portion, and wherein said blade receiving portions are spaced from each other along the length of said blade, each said blade receiving portion including a groove in which said blade is secured;

(C) a skate blade secured to said blade holder, said blade including a surface contacting edge and an upper surface opposite said edge;

(D) at least one vibration dampening member positioned within said support mount for dampening vibrations experienced by said skate blade;

(E) a plurality of fasteners for securing said skate blade to said skate holder;

(F) each said blade receiving portion including a pair of aligned apertures; and said blade including a plurality of apertures, each of which is aligned with a respective pair of said aligned apertures of said blade receiving portions for receiving one of said fasteners; and (G) a bumper positioned at the front of said skate blade and covering a portion of said blade, a portion of said bumper extending within one of said apertures of said pair of blade receiving portion apertures and a respective one of said blade apertures.

2. The ice skate according to claim 1 wherein one of said support mounts and a portion of said upper surface of said blade define an opening which extends along a portion of said blade.

3. The ice skate according to claim 1 wherein said at least one vibration dampening member includes a plurality of vibration dampening members which each extend within one of said apertures of each said pair of blade receiving portion apertures.

4. The ice skate according to claim 1 wherein said at least one vibration dampening member is positioned between said blade and one of said fasteners.

5. The ice skate according to claim 1 wherein said bumper is formed of a vibration dampening material.

6. The ice skate according to claim 1 wherein said vibration dampening member includes an elastomeric material such as TPU and said support mount is formed of a light weight metal.

7. The ice skate according to claim 1 wherein said support mount is formed of a lightweight composite material.

8. The ice skate according to claim 3 wherein each said fastener is positioned within a respective one of said vibration dampening members such that each vibration dampening member is positioned about at least a portion of said fastener extending within a respective one of said support mounts.

9. The ice skate according to claim 3 wherein each of said vibration dampening members extends within a respective one of said blade apertures.

10. The ice skate according to claim 6, wherein said lightweight material is aluminum.

11. An ice skate comprising:

(A) a foot receiving member;

(B) a skate blade for contacting a surf ace, said blade including a plurality of through-holes for receiving a fastener;

(C) first and second support mounts spaced from one another along a length of said blade for receiving portions of the foot receiving member;

(D) said first and second support mounts each having a forward blade receiving portion at a first end and a rear blade receiving portion at a second end, (E) a bumper positioned along said blade between the second end of said first support mount and the first end of said second support mount for coupling said support mounts together, wherein a first end of said bumper is positioned proximate said second end of said first support mount and a second end of said bumper is positioned proximate said first end of said second support mount.

12. The ice skate according to claim 11 further including a plurality of fasteners, each positioned within a respective one of said blade through-holes for securing said skate blade and said support mounts together.

13. The ice skate according to claim 11 wherein said bumper is one of a plurality of spaced apart bumpers positioned along the length of said blade.

14. The ice skate according to claim 11 wherein said support mounts are formed of a rigid, lightweight metal such as aluminum.

15. The ice skate according to claim 11 wherein said support mounts are formed of a lightweight, rigid material.

16. The ice skate according to claim 12 wherein said support mounts include a plurality of aligned holes and each said fastener is positioned within a respective pair of said support mount aligned holes and one of said skate blade through-holes.

17. The ice skate according to claim 14, wherein said rigid, lightweight metal is aluminum.

18. The ice skate according to claim 16 further comprising a plurality of elastomeric vibration dampening members, each said member being positioned between a respective one of said fasteners and one of said holes in said support mounts for dampening the vibrations experienced by said skate blade.

19. The ice skate according to claim 16 further comprising a plurality of elastomeric vibration dampening members, each said member extending within a respective aligned pair of said support mount holes and one of said skate blade through-holes.

20. The ice skate according to claim 15, wherein said lightweight, rigid material is a composite formed of aluminum and silicon carbide.

21. An ice skate comprising:

(A) a foot receiving member;

(B) a skate blade having a first end and a hole therein proximate said first end;

(C) a blade holder attached to said foot receiving portion and including a support mount having a first end, said first end of said support mount including a pair of holes aligned with said hole in said skate blade;

(D) a bumper positioned adjacent said skate blade first end and including a hole aligned with said hole in said skate blade and said holes in said support mount; and (E) a fastener extending through said aligned holes in said skate blade, said support mount and said bumper for coupling said skate blade, support mount and bumper together.

* * * * *